United States Patent [19]

Matkan

[11] 3,951,836

[45] Apr. 20, 1976

[54] TONERS FOR ELECTROSTATIC IMAGING

[75] Inventor: Josef Matkan, Malvern, Australia

[73] Assignee: Canon Kabushiki Kaisha, Tokyo, Japan

[22] Filed: Dec. 15, 1971

[21] Appl. No.: 208,505

Related U.S. Application Data

[63] Continuation of Ser. No. 669,350, Sept. 7, 1967, abandoned.

[30] Foreign Application Priority Data

Sept. 12, 1966 Australia ..... 10897/66

[52] U.S. Cl. ..... 252/62.1 R; 260/267

[51] Int. Cl.[2] ..... G03G 9/04

[58] Field of Search ..... 252/62.1; 260/267

[56] References Cited

UNITED STATES PATENTS

| | | | |
|---|---|---|---|
| 2,209,902 | 7/1940 | Ralston et al. | 252/62.1 |
| 3,296,140 | 1/1967 | Zabiak | 252/62.1 |
| 3,535,244 | 10/1970 | Zabiak | 252/62.1 |
| 3,647,696 | 3/1972 | Olson | 252/62.1 |

FOREIGN PATENTS OR APPLICATIONS

| | | | |
|---|---|---|---|
| 254,262 | 2/1961 | Australia | 252/62.1 |

OTHER PUBLICATIONS

Colour Index, Second Edition 1956, Vol. 2, p. 2901.

Colour Index, Second Edition 1956, Vol. 3, pp. 3409 and 3419–3421.

Ghosh et. al., Journal of Indian Chemical Society, Vol. 41, No. 8, 1964, pp. 567–572.

*Primary Examiner*—Jack P. Brammer

*Attorney, Agent, or Firm*—Fitzpatrick, Cella, Harper & Scinto

[57] ABSTRACT

This invention relates to a toner for electrostatic image and for liquid development thereof. According to this invention, the inventive toner eliminates the need for a control agent in the form of a coating on the toner particles by the chemical combination of a reactive material with a reactive coloring material.

5 Claims, No Drawings

TONERS FOR ELECTROSTATIC IMAGING

This is a continuation of application Ser. No. 669,350 filed Sept. 7, 1967, and now abandoned.

The present invention relates to a toner for electrostatic image and liquid developer comprising the toner.

In the past liquid developers for electrophotographic purposes have comprised pigments or the like suspended in insulating liquids, such as liquids having a volume resistivity in excess of $10^9$ ohm centimeter and dielectric constant less than 3. There are so-called positive and negative liquid developers. A positive developer contains toner particles which are attracted by negative electrostatic charges. A negative developer contains toner particles which are attracted by positive electrostatic charges, or which upon contact with a surface bearing latent image areas formed by negative electrostatic charges, are repelled by such negative charges and deposit onto the non-image areas. In order that the toner particles shall have the required polarity in suspension it has been customary in the past to coat the pigment particles with an oil or resin or oleoresinous varnish or the like, known as a control agent, and in addition other oils or resinous materials or combinations, at least partially soluble in the carrier liquid, are usually added to fix the developed image, these materials being known as fixing agents. In addition other materials may be added to aid dispersion and in an attempt to aid the stability of the dispersed toner.

It will be seen that presently known liquid developers are relatively complicated, and normally relatively complicated techniques need to be employed for their manufacture. In addition they suffer from several disadvantages, in that they are normally not capable of producing high density clean background image when used in conjunction with projection exposure techniques. Further due to their relatively complex composition they are normally of limited stability in suspension, and can also be of limited shelf life when in a concentrated form. Selective depletion may also change the characteristics of a particular toner suspension during use.

We have now found a method whereby these defects can be minimised, in that a toner suspension prepared in accordance with the teachings of this invention need not contain the prior art control agents, fixing agents, dispersing or stabilising additives or the like, although some of these may be added if desired.

In accordance with this instant invention the toner particles are either of the positive or of the negative type depending on the selection of materials. Such toner particles consist of homogeneous matter comprising a material known as control agent, fixing agent and/or dispersing agent such as oils, fatty acids, carboxylic acids, their derivatives of aliphatic organic compounds and aromatic organic compounds, oleoresinous materials, polymeric materials, plastic materials and the like in chemical combination with a reactive coloring material. The coloring material in this invention is a reactive substance which produces a color upon chemical combination with the other reacting component as mentioned above or produces a color by a treatment after the chemical combination. Naturally the coloring material may have inherently a color and may retain the same color after the chemical combination.

The coloring material includes pigments and dyes having reactive radical such as = NH, $-NH_2$, —OH, —COOH, —Cl, —Br and the like, for example, triphenylmethane dye, azo dye, azine dye, reactive dyestuff, reactive pigment, coloring organic compounds such as aniline, chloranil, amines and the like, and dye intermediates such as couplers used for diazo color development, couplers used for photographic coloring reaction and the like. Further, leuco bases of dye of triphenylmethanes and cyanines are also included in the coloring material of this invention. Such chemically combined particles may be insoluble in the carrier liquid but whilst being substantially insoluble they may also be softened or swollen by contact with the carrier liquid. In case the chemically combined particles are insoluble in the carrier liquid it is also possible to employ an intermediate solvent in order to attain the required degree of softening or swelling of the particles suspended in the carrier liquid. Such intermediate solvents need to be used in relatively small quantities only sufficient to attain the required degree of softening and such intermediate solvent may then be fully contained within the softened or swollen toner particle without forming an excess which may impair the electrical properties of the carrier liquid by mixing therewith. Image deposits formed by such softened or swollen chemically combined toner particles become fixed upon evaporation of the carrier liquid and/or of the aforementioned intermediate solvent. The chemically combined toner particles may be also thermoplastic in order that the heat normally used to evaporate the carrier liquid from the developed print may also fix by heat fusion the image deposit thereon. It is also possible to add to the suspension of the chemically combined toner particles in the carrier liquid a fixing resin or oil or oleoresinous varnish or the like, if required.

The chief advantage of the toner in accordance with this invention lies thus in the elimination of the need for a control agent in the form of a coating on the particle. Since a control agent is indispensable to the prior art, it is difficult in the prior art to obtain toners of extended stability and shelf life. This requirement of the prior art toners was extremely difficult if not impossible to fulfil as the control agents have invariably the tendency to desorb from the particle and thereby affect the stability and characteristics of the toner. The toner particles in accordance with this invention comprise homogeneous matter which is chemically combined and thus no part of the particle while in suspension can be selectively or preferentially desorbed or removed or changed by the carrier liquid, which is the chief requirement for toner stability.

Thus a liquid developer in accordance with the present invention comprises a carrier liquid of volume resistivity in excess of $10^9$ ohm cm. and dielectric constant less than 3, having suspended therein toner particles which are substantially insoluble in said carrier liquid but which may be softened or swollen by contact with said carrier liquid or by the optional presence of an intermediate solvent in a quantity not sufficient to affect the electrical properties of said carrier liquid and which toner comprises at least one member selected from the group consisting of aliphatic compounds, aromatic compounds, oleoresinous materials and plastic materials which is chemically combined with a reactive coloring material.

In addition a fixing or dispersing material at least partially soluble in the carrier liquid and comprising an oil or resin or oleoresinous varnish or the like may be included.

Further, a fixing and/or a dispersing material may be chemically combined to the above-mentioned toner.

In order that this invention may be more fully understood, reference will now be made to the following examples, but it is to be understood that the examples are intended to be illustrative only and shall not limit the scope of this invention as one skilled in the art of manufacturing liquid dispersed electrophotographic toners will be able to adapt the teachings of this invention to materials not mentioned herein without departing from the spirit of this invention.

EXAMPLE 1

A positive dark brown developer was prepared by heating 1 g. of aniline with 10 g. of colophony to attain stabilisation by reacting the amine groups of aniline with the abietic acid of the colophony and then adding to the molten material 1 g. of chloranil to react with the aniline to produce the desired color. The resultant compound was cooled to form a solid which was then ground with 1000 g. of isoparaffinic hydrocarbon to form the developer. The resultant image was heat fused for fixing. The abietic acid worked as a positive control agent.

EXAMPLE 2

The compound of Example 1 was ground in n-Heptane as the carrier liquid. This caused softening of the toner particles and consequently the resultant image was fixed upon evaporation of the carrier liquid. The colophony worked as a positive control agent and fixing agent.

EXAMPLE 3

The compound of Example 1 was dissolved in 25 g. of dipentene. The solution was precipitated with 1000 g. of isoparaffinic hydrocarbon as the carrier liquid. A suspension of fine toner particles in swollen state due to the presence of the intermediate solvent dipentene was obtained. The resultant image was fixed upon evaporation of the solvents. The colophony worked as a good fixing agent as well as a positive control agent.

EXAMPLE 4

10 g. of Gum Dammar were melted with 2 g. of the dye Brilliant Green Color Index No. 42040 until a color change to light brown occurred. Prolonged heating would result in loss of colour in view of the leuco reaction with the fatty acids contained in the Gum Dammar, and thus heating has to be terminated after partial reaction is detected by the colour change from the initial greenish blue to brown. At this stage the compound was chilled by the addition of 25 g. of cold isoparaffinic hydrocarbon. Then further 1000 g. of isoparaffinic hydrocarbon were added as the carrier liquid into which the compound was ground to form positive fine toner particles ranging in size from 0.10 to 40 microns. This produced a negative brown developer. The positive image formed by the toner was heat fused.

EXAMPLE 5

In example 4 when the partial reaction was detected by colour change and the compound was chilled with 25 g. of isoparaffinic hydrocarbon, 1000 g. of cyclohexane were added as the carrier liquid into which the compound was ground. This produced a suspension containing softened toner particles. The image formed was fixed upon evaporation of the solvents.

EXAMPLE 6

In example 4 when the partial reaction was detected by colour change the compound was chilled with 25. g. of perchlorethylene and then suspended in 1000 g. of the isoparaffinic hydrocarbon carrier liquid. A suspension was thus obtained containing softened toner particles in view of the intermediate solvent perchlorethylene. The resultant image was fixed upon evaporation of the solvents.

EXAMPLES 7, 8 and 9

In examples 4, 5 and 6 the natural resin Gum Dammar was replaced by synthetic resin Vandene P51, a modified maleic resin produced by Polymer Corp., acid value 170–190, melting point 120°–130°C, specific gravity 1.10.

EXAMPLE 10

10 g. of colophony were melted and 2 g. of the dye Rose Bengal Color Index No. 45435 were added. A bright magenta color is first produced and upon further heating the color changes to reddish due to the chemical reaction between the dye and the fatty acids in the colophony. The compound was then poured and precipitated into 1000 g. of cold isoparaffinic hydrocarbon carrier liquid and ground therein. This produced a positive reddish developer. The image was heat fused as the toner particles consisted of solid resinous matter.

EXAMPLE 11

The compound of example 10 was poured into 1000 g. of mineral spirits as the carrier liquid. A suspension was obtained of swollen toner particles resulting in an image which became fixed upon evaporation of the carrier liquid.

EXAMPLE 12

The compound of Example 10 was dissolved in 20 g. of Tetralin and then suspended in 1000 g. of isoparaffinic hydrocarbon carrier liquid. This produced a suspension of swollen particles and the resultant image was fixed upon evaporation of the solvents.

EXAMPLES 13, 14 and 15

In examples 10, 11 and 12 the colophony was replaced by the modified maleic resin Vandene P51. A reddish negative toner was obtained.

EXAMPLE 16

10 g. Of the modified maleic resin Vandene P51 were melted and 2 g. of the dye methylene blue Color Index No. 52015 were added. A bright blue colour is first produced and upon further heating the colour changes to brown due to the chemical reaction between the dye and the fatty acids in the maleic resin. The compound was then poured and precipitated into 1000 g. of isoparaffinic hydrocarbon carrier liquid and ground therein. This produced a negative brown developer. The image was heat fused as the toner particles consisted of solid resinous matter.

EXAMPLE 17

10 g. Of colophony were melted and 1 g. of the dye Rhodamine B Color Index No. 45170B was added. A bright magenta color is first produced as the dye becomes distributed. Heating is continued until a color change towards red is detected. The compound is then chilled with 30 g. of cold isoparaffinic hydrocarbon and added to further 1000 g. of isoparaffinic hydrocarbon carrier liquid. By simple stirring, surprisingly a very fine positive stable toner suspension is attained wherein the toner particles comprises resinous matter in swollen or softened state. The resultant image is fixed upon evaporation of the carrier liquid. The colophony as such is insoluble in the isoparaffinic hydrocarbon and in absence of the Rhodamine B dye a precipitate in the form of a hard lump would be produced. The presence of the Rhodamine B dye incorporated and reacted as described in the foregoing surprisingly increases the solubility of the colophony, possibly but not necessarily by the reaction taking place being of the type wherein a certain degree of hydrogenation or esterification may occur.

EXAMPLE 18

In example 17 the molten compound was dispersed in the carrier liquid trichlorotrifluoroethane. Again it was found that surprisingly a stable suspension of fine toner particles was obtained. The toner functioned as in example 17.

EXAMPLE 19

Oleic acid is cold soluble in isoparaffinic hydrocarbon. The dye Waxoline nigrosine GR Colour Index No. 50415 when milled with oleic acid and suspended in the isoparaffinic hydrocarbon carrier liquid produces a developer wherein the oleic acid is fully in solution and the dye particles act as toner particles resulting in a black coarse image which can not be fixed even by heat fusing. Boiling of the whole dispersion does not change the above characteristics. Further, the stability of the dispersion is poor and the nigrosine easily separates during storage. If however 10 g. of oleic acid is boiled for 10 minutes with 5 g. of the dye Waxoline nigrosine GR a color change towards the blue occurs and if at this stage this compound is dispersed in 1000 g. of the isoparaffinic hydrocarbon carrier liquid a fine and stable toner suspension is obtained by mere stirring wherein due to a chemical reaction having taken place between the oleic acid and the Waxoline nigrosine dye the toner particles are of the swollen type and substantially no oleic acid is in solution. The resulting image is positive, blue in colour and completely fixed.

It is clear that the reaction of the oleic acid with the nigrosine results in such excellent fixing property and dispersing property. The oleic acid works as a fixing and dispersing agent.

EXAMPLE 20

10 g. of colophony were melted and 0.5 g. of p-dimethyl amino benzaldehyde was added to partially react the amino groups with the fatty acids contained in the colophony. Then 0.5 g. of aniline hydrochloride was added to obtain a colour reaction with the benzaldehyde. An orange colour compound was thus produced and poured into 1000 g. of isoparaffinic hydrocarbon carrier liquid. By simple stirring a suspension of fine toner particles in softened state was obtained. The resulting image was positive and completely fixed upon evaporation of the carrier liquid. As in example 17, the solubility of the colophony has been surprisingly increased by the aforesaid chemical reaction.

EXAMPLE 21

In example 20 the colophny was replaced by the maleic modified resin Vandene P51. The resulting toner was negative and completely fixed. Hereagain a surprising increase in the solubility of the resin was attained by the chemical reaction.

EXAMPLE 22

In example 19, 10 g. of oleic acid and 5 g. of nigrosine were heated with agitation at 120°C for two hours and then at 200°–210°C for 7 hours on an oil bath. The viscosity of the system gradually increased by heating and the color of the reaction liquid changed from black to blue and then to black. After the heating reaction, viscous soft solid matter having lustrous black color was obtained. One part by weight of the soft solid matter and 20 parts by weight of a petroleum solvent were ball-milled for 48 hours, filtered, and unreacted oleic acid and polymerized oleic acid were washed and removed. The residue was further dispersed in a paraffinic carrier liquid to obtain a developer. A positive black image of good fixing property was obtained.

EXAMPLE 23

Induline base, Colour Index No. 50400 5 g., abietic acid 5 g., oleic acid 5 g., and stearic acid 2 g. were heated with agitation at 210°C for 8 hours. The resulting dark brown paste-like matter, 5 g., was dispersed with 40 g. of xylene for 3 days by a ball-mill, and 1 cc. of the resulting dispersion matter was added to one liter of an isoparaffinic petroleum solvent followed by stirring and mixing. A negative electrostatic image was changed to a positive black image. The resulting liquid developer was tested for 10 days for the shelf life and showed an excellent dispersing property. The abietic acid, the oleic acid and the stearic acid were used for giving a control effect, a fixing effect and a dispersion effect, respectively.

A reaction product prepared without abietic acid in the above procedure gave a negative image as the result of the developing test.

EXAMPLE 24

Nigrosine base 50415 5 g., caprylic acid 5 g., and benzoic acid 5 g. were heated with stirring at 120°C for 2 hours and then at 190°C for further 8 hours. The viscosity of the reaction mixture increased gradually to give a gel-like black matter.

One gram of the reaction product was dispersed in 20 g. of kerosene and ball-milled for 48 hours.

The resulting concentrated disperson dispersion (1 cc.) was added to 500 cc. of kerosene and agitated to form a liquid developer. Developing a negative electrostatic image gave a positive image of good fixing property. The benzoic acid serves to impart a positive control property while the caprylic acid serves to impart a fixing property.

EXAMPLE 25

A reactive dyestuff having triazine ring (1 g.) was caused to react with 5 g. of nonylphenol and these compounds were chemically combined by dehydrochlorination between the halogen attached to the triazine ring of the reactive dyestuff and the phenol. The resulting blue product was dispersed and suspended in an isoparaffinic petroleum solvent to form a liquid developer. The resulting developer gave a positive image of excellent fixing property and was of excellent shelf life. Nonylphenol imparts control effect, fixing effect and dispersing effect to the product.

EXAMPLE 26

Five grams of 4-amino copper phthalocyanine was caused to react with 10 g. of oleic acid chloride in a pyridine solution in the absence of water to combine chemically the oleyl group to the copper phthalocyanine. The resulting semi-solid blue product (1 g.) was dispersed and suspended in one liter of kerosene by ball-milling. The resulting dispersion solution was used as a liquid developer to develop a negative electrostatic image and a positive blue fixed image was formed. This image was of excellent light resistance and the density of image was high. The oleic acid chloride imparts of fixing effect and a dispersing effect to the reaction product.

I claim:

1. A liquid developer for electrophotography comprising a carrier liquid of volume resistivity in excess of $10^9$ ohm cm. and dielectric constant less than 3, toner particles suspended therein, which are substantially insoluble in said carrier liquid and said toner particles characterized by containing as the effective component a product obtained by reacting an azine dye selected from the group consisting of nigrosine C.I. 50415 and induline C.I. 50400 with a $C_8$–$C_{20}$ fatty acid at elevated temperatures until a color change occurs in the reaction mixture and thereafter recovering the product.

2. A liquid developer for electrophotography comprising a carrier liquid of volume resistivity in excess of $10^9$ ohm cm. and dielectric constant less than 3, toner particles suspended therein, which are substantially insoluble in said carrier liquid and said toner particles characterized by containing as the effective component a product obtained by reacting nigrosine C.I. 50415 dye and oleic acid at least at about the boiling point of the reaction mixture for a sufficient time to produce a color change in said reaction mixture and thereafter recovering the product.

3. The liquid developer of claim 2 wherein the reaction mix is maintained at about 120° for about 2 hours and thereafter maintained at about 200°–210° C. for about 7 hours wherein the color of the reaction mix changes in sequence, from black to blue to black.

4. The liquid developer of claim 2, wherein the acid is a mixture of caprylic acid and benzoic acid and the reaction mixture is heated at about 120°C. for 2 hours and thereafter maintained at 190°C. for about 8 hours.

5. A liquid developer for electrophotography comprising a carrier liquid of volume resistivity in excess of $10^9$ ohm cm. and dielectric constant less than 3, toner particles suspended therein, which are substantially insoluble in said carrier liquid and said toner particles characterized by containing as the effective component a product obtained by reacting an induline dye, C.I. 50400 with a mixture of fatty acids consisting of abietic acid, oleic acid and stearic acid at a temperature of 210° for about eight hours and thereafter recovering the product.

* * * * *